United States Patent [19]

Widin et al.

[11] Patent Number: 4,992,966

[45] Date of Patent: Feb. 12, 1991

[54] CALIBRATION DEVICE AND AUDITORY PROSTHESIS HAVING CALIBRATION INFORMATION

[75] Inventors: Gregory P. Widin, West Lakeland, Minn.; Stephan E. Mangold, Alingsas; Mats B. Dotevall, Gothenburg, both of Sweden

[73] Assignee: Minnesota Mining and Manufacturing Company, St. Paul, Minn.

[21] Appl. No.: 192,213

[22] Filed: May 10, 1988

[51] Int. Cl.[5] ..... H04R 25/00

[52] U.S. Cl. ..... 364/571.04; 381/68; 128/746; 379/52; 73/585

[58] Field of Search ..... 364/571.04, 571.03, 364/571.06, 571.07, 413.02; 73/585; 128/746; 381/60, 68, 68.2, 68.4, 68.6, 98; 379/52

[56] References Cited

U.S. PATENT DOCUMENTS

| | | | |
|---|---|---|---|
| 4,425,481 | 1/1984 | Mangold et al. | 381/68 |
| 4.548,082 | 10/1985 | Engebretsen et al. | 73/585 |
| 4,577,641 | 3/1986 | Hochmair et al. | 128/746 |
| 4,611,304 | 9/1986 | Butenko et al. | 364/571.07 |
| 4,622,440 | 11/1986 | Slavin | 364/68 |
| 4,677,581 | 6/1987 | Malka et al. | 364/571.06 |
| 4,731,850 | 3/1988 | Levitt et al. | 381/68.2 |
| 4,759,070 | 7/1988 | Voroba et al. | 128/746 |
| 4,791,672 | 12/1988 | Nunley et al. | 381/68.2 |
| 4,852,175 | 7/1989 | Kates | 381/68.4 |

FOREIGN PATENT DOCUMENTS

| | | | |
|---|---|---|---|
| 2184629 | 6/1987 | United Kingdom | 381/68 |

*Primary Examiner*—Joseph L. Dixon

*Attorney, Agent, or Firm*—Donald M. Sell; Walter N. Kirn; William D. Bauer

[57] ABSTRACT

A calibration device for an auditory prosthesis, such as a hearing aid, and an auditory prosthesis which contains such a calibration device. The calibration device comprises memory in which is stored information which is characteristic of information intrinsic to the invididual auditory prosthesis, the information being either information which represents a sufficient set of adjustment parameters required to calculate the transfer function of the auditory prosthesis or manufcturing information and a mechanism by which this information may be utilized by the auditory prosthesis or by the programming system of such auditory prosthesis.

18 Claims, 1 Drawing Sheet

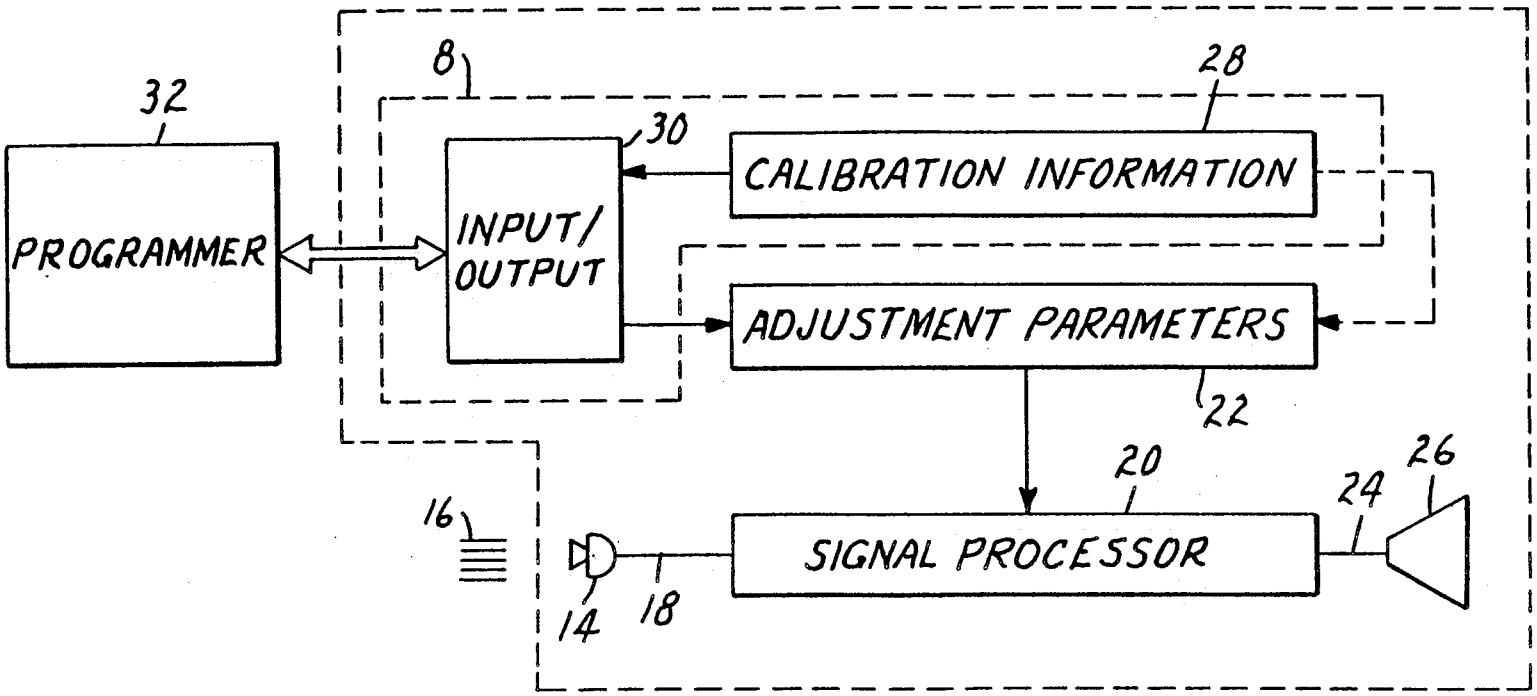
CALIBRATION INFORMATION
ADJUSTMENT PARAMETERS
SIGNAL PROCESSOR
INPUT/ OUTPUT
PROGRAMMER
8
14
16
18
20
22
24
26
28
30
32

CALIBRATION DEVICE AND AUDITORY PROSTHESIS HAVING CALIBRATION INFORMATION

BACKGROUND OF THE INVENTION

The present invention relates generally to auditory prostheses and more particularly to auditory prostheses which are adjustable by a programming system.

Auditory prostheses have been utilized to modify the auditory characteristics of sound received by a user of that auditory prosthesis. Usually the intent of the prosthesis is, at least partially, to compensate for a hearing impairment of the user or wearer. Hearing aids which provide an acoustic signal in the audible range to a wearer have been well known and are an example of an auditory prosthesis. More recently, cochlear implants which stimulate the auditory nerve with an electrical stimulus signal have been used to improve the hearing of a wearer. Other examples of auditory prostheses are implanted hearing aids which stimulate the auditory response of the wearer by a mechanical stimulation of the middle ear and prostheses which otherwise electromechanically stimulate the user.

Hearing impairments are quite variable from one individual to another individual. An auditory prosthesis which compensates for the hearing impairment of one individual may not be beneficial or may be disruptive to another individual. Thus, auditory prostheses must be adjustable to serve the needs of an individual user or patient.

The process by which an individual auditory prosthesis is adjusted to be of optimum benefit to the user or patient is typically called "fitting". Stated another way, the auditory prosthesis must be "fit" to the individual user of that auditory prosthesis in order to provide a maximum benefit to that user, or patient. The "fitting" of the auditory prosthesis provides the auditory prosthesis with the appropriate auditory characteristics to be of benefit to the user.

This fitting process involves measuring the auditory characteristics of the individual's hearing, calculating the nature of the acoustic characteristics, e.g., acoustic amplification in specified frequency bands, needed to compensate for the particular auditory deficiency measured, adjusting the auditory characteristics of the auditory prosthesis to enable the prosthesis to deliver the appropriate acoustic characteristic, e.g., acoustic amplification in specified frequency bands, and verifying that this particular auditory characteristic does compensate for the hearing deficiency found by operating the auditory prosthesis in conjunction with the individual. In practice with conventional hearing aids, the adjustment of the auditory characteristics is accomplished by selection of components during the manufacturing process, so called "custom" hearing aids, or by adjusting potentiometers available to the fitter, typically an audiologist, hearing aid dispenser, otologist, otolaryngologist or other doctor or medical specialist.

Some hearing aids are programmable in addition to being adjustable. Programmable hearing aids store adjustment parameters in a memory which the hearing aid can utilize to provide a particular auditory characteristic. Typically the memory will be an electronic memory, such as a register or randomly addressable memory, but may also be other types of memories such as programmed cards, switch settings or other alterable mechanisms having retention capability. An example of a programmable hearing aid which utilizes an electronic memory, in fact a plurality of memories, is described in U.S. Pat. No. 4,425,481, Mangold et al. With a programmable hearing aid which utilizes electronic memory, a new auditory characteristic, or a new set of adjustment parameters, may be provided to the hearing aid by a host programming device which includes a mechanism for communicating with the hearing aid being programmed.

Such programmable hearing aids may be programmed specifically to provide an auditory characteristic which, it is hoped, will compensate for the measured hearing impairment of the user. However, while the programming of such hearing aids may be digital, and thus very precise, the actual signal processing circuitry of the hearing aid may very well be analog. Because there are variations between individual analog components, at least in part due to semiconductor process variation, the actual auditory characteristic provided by a given individual hearing aid may be somewhat different than that actually "prescribed" by the programming system. Further, other characteristics of the individual hearing aid, such as model number, revision number, manufacturing date code, serial number and optional features actually contained in the hearing aid, may be important to the programming system of the hearing aid and need to be manually input by the programming system into the fitting process. Such manual input is not only inconvenient but also is a source of error which could cause a less than optimum fitting to be obtained.

U.S. Pat. No. 4,548,082, Engebretson et al, Hearing Aids, Signal Processing Systems For Compensating Hearing Deficiencies, and Methods, discloses the use of "calibration" information, which may be stored in the memory of the hearing aid, in the programming of a digital hearing aid (column 16, lines 13–22). The "calibration" information contemplated by Engebretson et al are transfer functions (column 24, line 57 through column 25, line 6) which provide a factory estimate of the hearing aid/probe microphone/ear canal interface referred in the context of "ear volume" (column 14, line 28 through column 16, line 12). In order to make this data usable it must be adjusted to take into account the actual hearing aid/patient interface data instead of the factory data using the "standard coupler" (column 16, lines 23–36). Engebretson et al stores a sufficient transfer function, i.e., a sufficient set of the acoustic relationship from the input to the output of the hearing aid, taken at four different frequencies. Since the sufficient transfer function data encompasses a large volume of data, data for only four distinct frequencies can be stored. The acoustic relationship of input and output must then be interpolated from this data.

SUMMARY OF THE INVENTION

The present invention provides a calibration device for an auditory prosthesis, such as a hearing aid, using information unique and intrinsic to that individual auditory prosthesis and an auditory prosthesis which contains such a calibration device.

The calibration device comprises memory in which is stored information which is characteristic of information intrinsic to the individual auditory prosthesis and a mechanism by which this information may be utilized by the auditory prosthesis or by the programming system of such auditory prosthesis. The information stored must also be either representative of a sufficient set of a set of adjustment parameters which are required for the calculation of a relationship between the auditory input signal and an output signal, or represent manufacturing information of the auditory prosthesis.

The storage of calibration information intrinsic to the individual auditory prosthesis and which either represents a sufficient set of adjustment parameters required to calculate the relationship between the input and the output, i.e., the transfer function, or manufacturing information provides a much different result than that obtained by Engebretson et al. Engebretson et al stores data representing the transfer function of the hearing aid taken at four different frequencies. The limitation on only four frequency points is required since to store data representing the transfer function at all frequencies would require a great deal of memory. The present invention stores only the adjustment parameters required to calculate the transfer function rather than the entire transfer function itself. Thus, the calibration information provides a sufficient set of information, without estimates or interpolation between frequencies, of the individual intrinsic information of the auditory characteristics of the auditory prosthesis or manufacturing information for the individual auditory prosthesis without consuming large amounts of memory space. The calibration information of the present invention supplies the programming system with sufficient information, potentially highly variable, about the unique characteristics of the individual auditory prosthesis. The programming system may then utilize this information in optimizing the adjustment of the acoustic parameters without further use of the individual auditory prosthesis.

Since information representing the sufficient, actual performance of individual analog components or the actual performance of the analog circuitry as a whole may be stored in the auditory prosthesis itself and that information is available to the programming system, the programming system may take that information into account in order to provide adjustment parameters not only for the auditory prosthesis of that type in general but may provide specific adjustment parameters which are specifically tailored to that individual auditory prosthesis. Thus, each individual auditory prosthesis may be programmed exactly, not just within the normal tolerance values of the analog circuitry.

Since information representing the actual individual manufacturing characteristics of the individual auditory prosthesis such as model number, revision number, manufacturing date code, serial number and optional features is actually contained in the hearing aid, this information may be automatically read out by the programming system of the auditory prosthesis thus negating the need for manual input for this information and obviating the possibility for error. Thus, the actual version of auditory prosthesis being programmed and its individual idiosyncrasies can be "transparent" to the programming system.

The present invention provides an auditory prosthesis which has a relationship between an auditory input signal and an output signal and which is adjustable by a programming system and has a signal input mechanism responsive to the auditory input signal for supplying an electrical input signal, a signal processing mechanism responsive to the electrical input signal for processing the electrical input signal in accordance with adjustment parameters and producing a processed electrical signal, the adjustment parameters being adjustable by the programming system and a transducer mechanism responsive to the processed electrical signal for converting the processed electrical signal to the output signal adapted to be perceptible to a person. The auditory prosthesis further has a calibration mechanism for storing calibration information characteristic of information intrinsic to the individual auditory prosthesis, the calibration information either representing a sufficient set of adjustment parameters which are required for the calculation of the input/output relationship or representing manufacturing information, the calibration mechanism being readable and usable by the programming system in the adjustment of the adjustment parameters.

The present invention also provides a programmable hearing aid having a relationship between an auditory input signal and an output signal and which is programmably adjustable through the use of digital adjustment parameters by a programming system and has a microphone responsive to the auditory input signal converting that auditory input signal into an electrical input signal, a signal processor responsive to the electrical input signal for processing the electrical input signal in accordance with digital adjustment parameters and producing a processed electrical signal and a receiver responsive to the processed electrical signal for converting the processed electrical signal to the output signal which is adapted to be perceptible to a person. The programmable hearing aid also has a calibration mechanism for digitally storing calibration information characteristic of information intrinsic to the individual auditory prosthesis, the calibration information either representing a sufficient set of adjustment parameters which are required for the calculation of the input/output relationship or representing manufacturing information, the calibration mechanism being readable and usable by the programming system in the adjustment of the digital adjustment parameters.

The present invention also provides a calibration device for a programmable hearing aid which has a relationship between an auditory input signal and an output signal and which is programmably adjustable through the use of digital adjustment parameters by a programming system. A calibration mechanism digitally stores calibration information characteristic of information intrinsic to the individual auditory prosthesis, the calibration information either representing a sufficient set of adjustment parameters which are required for the calculation of the input/output relationship or representing manufacturing information. An input/output mechanism which is operably coupled to the calibration mechanism allows the calibration information to be read and used by the programming system in the adjustment of the digital adjustment parameters.

BRIEF DESCRIPTION OF THE DRAWING

The foregoing advantages, construction and operation of the present invention will become more readily apparent from the following description and accompanying drawing in which the FIGURE is a block diagram of an auditory prosthesis of the present invention which incorporates the calibration device of the present invention.

DETAILED DESCRIPTION OF THE PREFERRED EMBODIMENTS

U.S. Pat. No. 4,425,481, Mangold et al, Signal Processing Device, which is hereby incorporated by reference, discloses a signal processing mechanism for an auditory prosthesis or hearing aid which could be utilized in conjunction with the present invention. The signal processor in Mangold et al is controlled by a selected set of adjustment parameters which are stored within the signal processing device itself. The selection process is controlled by the user or is automatic. Since these adjustment parameters are digitally stored within the signal processor, very precise specifications can be developed for these adjustment parameters based upon a fitting process which determines the proper fitting of an auditory prosthesis utilizing the signal processor to be utilized in conjunction with the individual hearing impairment of the user.

However, while the programming of the signal processor may be digital, and thus very precise, the actual signal processing circuitry of the signal processor may be analog. Because there are variations in individual analog components, at least in part due to the semiconductor process variation, the actual auditory characteristic provided by a given individual signal processor may be somewhat different than that actually prescribed by the programming system. Further, other characteristics of the individual signal processor, such as model number, revision number, manufacturing date code, serial number and optional features actually contained in the signal processor, may be important to the programming system of the signal processor and need to be manually input by the programming system into the fitting process. Such manual input is not only inconvenient but is also is a source of error which could cause a less than optimum fitting to be obtained. Even if the signal processing portion of the auditory prosthesis were digital, there still must, by necessity, be some analog components such as transducer components, e.g., microphone and receiver, that have variable auditory characteristics.

The calibration device 8 of the present invention, is shown operating in conjunction with an auditory prosthesis 10 illustrated by the block diagram of the FIGURE. A microphone 14 receives an acoustic input 16 and transforms that acoustic input 16 into an electrical input signal 18 which is supplied to signal processor 20. While the present invention has been described in terms of an analog signal processor 20, it is to be recognized and understood that the present invention is just as applicable to a digital signal processor 20. The signal processor 20 processes the electrical input signal according to an auditory characteristic as determined by adjustment parameters 22 and supplies a processed electrical signal 24 to a receiver 26 which, in auditory prosthesis parlance refers to an electrical to acoustic transducer such as a speaker. While this discussion generally refers to hearing aids and, hence, to a receiver, it is to be recognized and understood that the present invention also finds usefulness in other forms of auditory prostheses such as cochlear implants, in which case the transducer would be an electrode or pair of electrodes, implanted hearing aids, in which case the transducer would be an electrical to mechanical transducer and tactile aids, in which case the transducer would be a vibrotactile device. Adjustment parameters 22 are illustrated in the FIGURE generally. It is to be recognized and understood that these adjustment parameters, while preferably digital, could also be analog and could represent a single set of adjustment parameters which specify a single auditory characteristic or could represent a range of varying sets of adjustment parameters which may be selected and utilized individually or in combination by the signal processor 20.

Calibration device 8 operates in conjunction with the remainder of the auditory prosthesis 10 by storing calibration information characteristic of information intrinsic to the individual auditory prosthesis involved. This information is stored in calibration information memory 28. The calibration information in calibration information memory 28 is supplied through input/output mechanism 30 and can be read by a programming system 32. Input/output mechanism 30 represents a standard digital input/output port and is conventional. Calibration information memory 28 is a digital memory such as a RAM or register which allows the storage of digital information and is also conventional. Programming system 32 represents a programming system which may be a computer system operating automatically or a human operating in conjunction with a host computer which are commonly known and are utilized to program digital auditory prostheses. An example of a fitting system which may be utilized for fitting system 32 is the DPS (Digital Programming System) which uses the SPI (Speech Programming Interface) programmer, available from Cochlear Corporation, Boulder, Colo. This system is designed to work with the WSP (Wearable Speech Processor), also available from Cochlear Corporation.

The information stored in calibration memory 28 in the calibration device 8 may be stored at any time during the life of the auditory prosthesis. However, it is envisioned and preferred that the calibration information in calibration memory 28, for the most part, be determined and stored at the time of manufacture, sale and/or repair of the auditory prosthesis. The auditory prosthesis 10 may be tested upon completion of manufacture to determine the particular auditory characteristics of the analog components of the signal processor 20 or other components of the auditory prosthesis which contribute to the auditory performance of the auditory prosthesis. The values of such circuitry characteristics may then be stored following manufacture in the calibration information in calibration memory 28. The storing of such calibration information in calibration memory 28 has the additional advantage of converting the electrical specification of the auditory prosthesis 10 into digital, meaningful terms so that the programming system 32 can translate the acoustic parameters of the auditory prosthesis 10 into bit patterns for the auditory prosthesis 10. Thus, a desired sound pressure level, for example, can be achieved despite variations in the sensitivity of the microphone 14, the signal processor 20 or the receiver 26.

An additional goal of the calibration information in calibration memory 28, is to store information about the manufacturing configuration of the auditory prosthesis 10. For example, a general purpose electronic module may be utilized in auditory prosthesis, in particular, hearing aids, which include whether the particular hearing aid is a "behind the ear" or "in the ear". Such devices either have telecoil or do not have telecoil, have volume control or do not have volume control, etc. By storing the calibration information in calibration memory 28 in the individual auditory prosthesis 10, the programming system 32 may operate on the auditory prosthesis 10 without any need for the programming system 32 to identify the model number, revision number, manufacturing date code, serial number and optional features actually contained in the auditory prosthesis. In addition, internal changes such as circuit configuration improvements made during manufacture or subsequent to manufacture can be identified in the calibration information in calibration memory 28 and the auditory prosthesis 10 may be programmed by the programming system 32 appropriately in a manner which is "transparent" to the programming system 32.

Another use of the calibration information 28 is an error checking or error correcting code which allows the detection of an error by the programming system 32 and, in the case of an error correcting code to correct that error to prevent an erroneous programming of the auditory prosthesis 10.

A specific example of the particular information stored in calibration information memory 28 for a particular hearing aid is as followed with the appropriate number of binary bits allocated to each information item indicated:

| Information Item | Binary Bits |
|---|---|
| LP attenuation at MPO | 8 |
| LP AGC code at MPO-10 | 6 |
| LP gain at 60 dB SPL | 6 |
| HP attenuation at MPO | 8 |
| HP AGC code at MPO-10 | 6 |
| HP gain at 60 dB SPL | 6 |
| Crossover frequency code | 8 |
| Microphone gain at 3% THD, 90 dB in | 5 |
| Maximum telecoil gain without feedback | 4 |
| Telecoil setting to balance with microphone at standard settings | 4 |
| Output amplifier calibration | 5 |
| Threshold Voltage | 3 |
| Reference test gain settings | |
| Microphone gain | 5 |
| LF gain | 8 |
| HF gain | 8 |
| output | 5 |
| Ser. No. | 24 |
| Revision level | 4 |
| place of assembly | 2 |
| date code | 16 |
| telecoil present | 1 |
| TOTAL CALIBRATION BITS | 142 |

The following procedure is an example of a calibration procedure which may be utilized to obtain the calibration information 28 to be utilized in conjunction with a particular auditory prosthesis 10, or hearing aid. In this calibration procedure:

(Step 1) The input of the hearing aid is set to 90 dB SPL at 2.5 kiloHertz. The high pass automatic gain control is set to linear with a release time set to its longest available setting. The low pass automatic gain control is set to linear with the low pass automatic gain control release time set to its longest value. The low pass and high pass attenuations are set to 10 dB. The filter crossover is set to 1,000 Hertz nominal. The output of the hearing aid is measured acoustically from the receiver. The microphone gain is adjusted to a value at which 3% THD is achieved at the output. This value is a calibration value for the microphone attenuation.

(Step 2) With the input to the hearing aid set as before, the high pass attenuation is adjusted to obtain a level of 128 dB SPL at the output. The value of the high pass attenuation is, thus, the reference attenuation setting for the high pass channel. In a particular hearing aid, the design value is about 10 dB.

(Step 3) With the hearing aid set as above, set the input signal to 2.5 kiloHertz, 60 dB SPL, the output level is measured. The input level is then increased to 90 dB SPL and the automatic gain control threshold is adjusted to achieve the same output level as with 60 dB SPL input. The value obtained is the reference automatic gain control attenuation for the high pass channel.

(Step 4) The process described in step 2 is now repeated but with a 250 Hertz input signal at 90 dB SPL and the low pass attenuation is adjusted for a level of 120 dB SPL. This is the reference attenuation setting for the low pass channel. In a particular hearing aid, the design value is about 10 dB.

(Step 5) The hearing aid is now set to the condition it was in at the end of step 4. The input signal is set at 250 Hertz, 60 dB SPL input. The output level is measured. Now the input level is increased to 90 dB SPL and the automatic gain control threshold is adjusted to achieve the same output level as with 60 dB SPL. This is the reference automatic gain control attenuation setting for the low pass channel.

(Step 6) The low pass attenuation is now set to the reference value and the high pass attenuation is set to maximum. The signal source is set to 250 Hertz at 90 dB SPL. The output level is measured at 250 Hertz and the frequency of the signal input is increased until the output is 3 dB down from the level at 250 Hertz.

(Step 7) The high pass attenuation is now set to reference and the low pass attenuation to maximum. The signal source is set to 2.5 kiloHertz at 90 dB SPL. The output level is measured at 2.5 kiloHertz. The frequency of the input signal is now decreased until the output is 3 dB down from the level at 2.5 kiloHertz. If the 3 dB down points obtained in steps 6 and 7 are equal for the low and high pass filters, respectively, the measurement is sufficient. If not, iterate until the frequency is found which the output levels for each channel are equal. This is the calibration frequency value for the crossover frequency between low pass and high pass channels.

The crossover frequency calibration factor to be stored in the calibration information memory 28 is computed as the value of the frequency measured in step 7 divided by 10.

The calibration constants stored in the calibration information memory 28 are those values determined above, and each correspond to the bit code needed to achieve a specific calibration condition. The procedure detailed is for a behind the ear version of a hearing aid. The value of threshold voltage is measured in production and is not changed as part of the acoustic calibration process. This value is simply stored in the calibration information memory 28.

The reference test gain position is the adjustment of the hearing aid which results in an output 17 dB below the HFA-SSPL90, i.e., the position giving average output at 1.0, 1.6 and 2.5 kilohertz 17 dB below its value with full-on/gain, measured using a 60 dB SPL input signal. In the reference test position, the hearing aid should also be set to its nonautomatic gain control mode, since for automatic gain control aids the reference test gain is the same as full on gain.

Thus, it can be seen that there has been shown and described a novel calibration device for an auditory prosthesis, such as a hearing aid, and an auditory prosthesis which contains such a calibration device. It is to be recognized and understood, however, that various changes, modifications and substitutions in the form and the details of the present invention may be made by those skilled in the art without departing from the scope of the invention as defined by the following claims.

What is claimed is:

1. An individual auditory prosthesis having a relationship between an auditory input signal and an output signal, said auditory prosthesis being adjustable by a programming system, comprising:

signal input means responsive to said auditory input signal for supplying an electrical input signal;

signal processing means responsive to said electrical input signal for processing said electrical input signal in accordance with a set of adjustment parameters and producing a processed electrical signal, said adjustment parameters being adjustable by said programming system;

transducer means responsive to said processed electrical signal for converting said processed electrical signal to said output signal which is perceptible to a person; and calibration means for storing calibration information characteristic of information intrinsic to said individual auditory prosthesis, said calibration information representing a sufficient subset of said set of adjustment parameters which are required in order to calculate said relationship, said calibration information being used by said programming system to adjust said adjustment parameters.

2. An auditory prosthesis as in claim 1 wherein said calibration information comprises information regarding variable electrical parameters of the individual auditory prosthesis.

3. An individual programmable hearing aid having a relationship between an auditory input signal and an output signal, said programmable hearing aid being programmably adjustable through the use of a set of digital adjustment parameters by a programming system, comprising:

a microphone for converting said auditory input signal into an electrical input signal;

a signal processor responsive to said electrical input signal for processing said electrical input signal in accordance with said set of digital adjustment parameters and producing a processed electrical signal;

a receiver responsive to said processed electrical signal for converting said processed electrical signal to said output signal which is perceptible to a person; and calibration means for storing calibration information characteristic of information intrinsic to said individual programming hearing aid, said calibration information representing a sufficient subset of said set of digital adjustment parameters which are required in order to calculate said relationship, said calibration information being used by said programming system to adjust said adjustment parameters.

4. A programmable hearing aid as in claim 3 wherein said calibration information comprises information regarding electrical parameters which are variable for different ones of a set of programmable hearing aids containing said programmable hearing aid.

5. An individual auditory prosthesis being adjustable by a programming system, comprising:

signal input means for supplying an electrical input signal;

signal processing means responsive to said electrical input signal for processing said electrical input signal in accordance with a set of adjustment parameters and producing a processed electrical signal, said adjustment parameters being adjustable by said programming system;

transducer means responsive to said processed electrical signal for converting said processed electrical signal to said output signal which is perceptible to a person; and calibration means for storing calibration information characteristic of information intrinsic to and regarding manufacturing information of said individual auditory prosthesis, said calibration information being used by said programming system in order to adjust said adjustment parameters.

6. An auditory prosthesis as in claim 5 wherein said manufacturing information comprises information regarding the serial number of the individual auditory prosthesis.

7. An auditory prosthesis as in claim 5 wherein said manufacturing information further comprises information regarding the revision level of the individual auditory prosthesis.

8. An auditory prosthesis as in claim 5 wherein said manufacturing information further comprises information regarding the date code of the individual auditory prosthesis.

9. An auditory prosthesis as in claim 5 wherein said calibration information comprises information regarding optional features contained in the individual auditory prosthesis.

10. An auditory prosthesis as in claim 5 wherein said adjustment parameters comprise digital data stored in said auditory prosthesis and said calibration information further comprises information regarding error checking of said digital data for the individual auditory prosthesis.

11. An auditory prosthesis as in claim 10 wherein said calibration information additionally comprises error correcting of the digital data for the individual auditory prosthesis.

12. An individual programmable hearing aid being programmably adjustable through the use of a set of digital adjustment parameters by a programming system, comprising:

a microphone for converting an acoustic signal into an electrical input signal;

a signal processor responsive to said electrical input signal for processing said electrical input signal in accordance with said set of digital adjustment parameters and producing a processed electrical signal;

a receiver responsive to said processed electrical signal for converting said processed electrical signal to a signal which is perceptible to a person; and calibration means for digitally storing calibration information characteristic of information intrinsic to and regarding manufacturing information of said individual programmable hearing aid, said calibration information being used by said programming system in order to adjust said digital adjustment parameters.

13. A programmable hearing aid as in claim 12 wherein said manufacturing information comprises information regarding the serial number of the individual programmable hearing aid.

14. A programmable hearing aid as in claim 12 wherein said manufacturing information further comprises information regarding the revision level of the individual programmable hearing aid.

15. A programmable hearing aid as in claim 12 wherein said manufacturing information further comprises information regarding the date code of the individual programmable hearing aid.

16. A programmable hearing aid as in claim 12 wherein said calibration information comprises information regarding optional parameters contained in the individual programmable hearing aid.

17. A programmable hearing aid as in claim 12 wherein said calibration information further comprises information regarding error checking of the digital adjustment parameters for the individual programmable hearing aid.

18. A programmable hearing aid as in claim 17 wherein said calibration information additionally comprises error correcting of the digital adjustment parameters for the individual programmable hearing aid.

* * * * *